US006746286B2

(12) United States Patent
Blaha

(10) Patent No.: US 6,746,286 B2
(45) Date of Patent: Jun. 8, 2004

(54) PUSH-IN WIRE CONNECTOR

(75) Inventor: William E. Blaha, St. Charles, IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 10/091,854

(22) Filed: Mar. 6, 2002

(65) Prior Publication Data

US 2003/0171041 A1 Sep. 11, 2003

(51) Int. Cl.[7] ..... H01R 11/09

(52) U.S. Cl. ..... 439/787; 439/436; 439/440; 439/862

(58) Field of Search ..... 439/787, 788, 439/789, 786, 436, 437, 438, 439, 440, 441, 862

(56) References Cited

U.S. PATENT DOCUMENTS 4,580,863 A * 4/1986 Lohr et al. ..... 339/94
5,454,730 A * 10/1995 Tozuka ..... 439/438
5,975,940 A * 11/1999 Hartmann et al. ..... 439/441
6,093,052 A * 7/2000 Wang ..... 439/441
6,250,950 B1 * 6/2001 Pallai ..... 439/411
6,280,233 B1 * 8/2001 Beege et al. ..... 439/441

* cited by examiner

*Primary Examiner*—Truc Nguyen
(74) *Attorney, Agent, or Firm*—Cook, Alex, McFarron, Manzo, Cummings & Mehler, Ltd.

(57) ABSTRACT

A connector for connecting electrical conductors includes a housing, a generally rectangular electrically conductive busbar and a pressure spring. The housing defines an enclosure and a plurality of front ports which provide access to the enclosure. Receptacles formed in the housing are spaced from and aligned with the front ports to receive the ends of conductors inserted into the connector. The busbar and pressure spring are disposed in the housing intermediate the front ports and receptacles. When electrical conductors are inserted into the housing, the pressure spring engages with the conductors to retain the conductors in the housing and bias the conductors into electrical engagement with the busbar.

20 Claims, 2 Drawing Sheets

Fig. 1
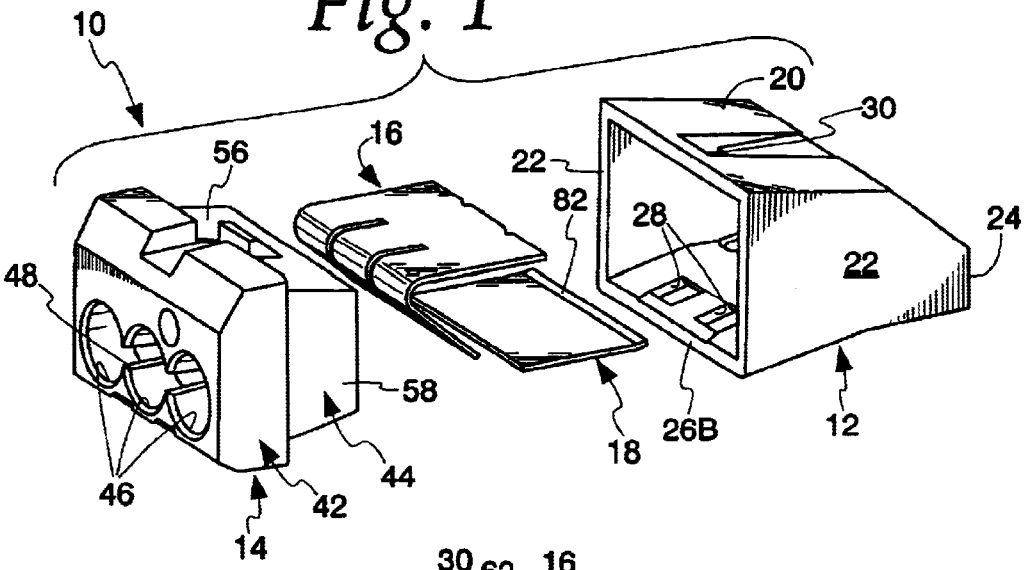
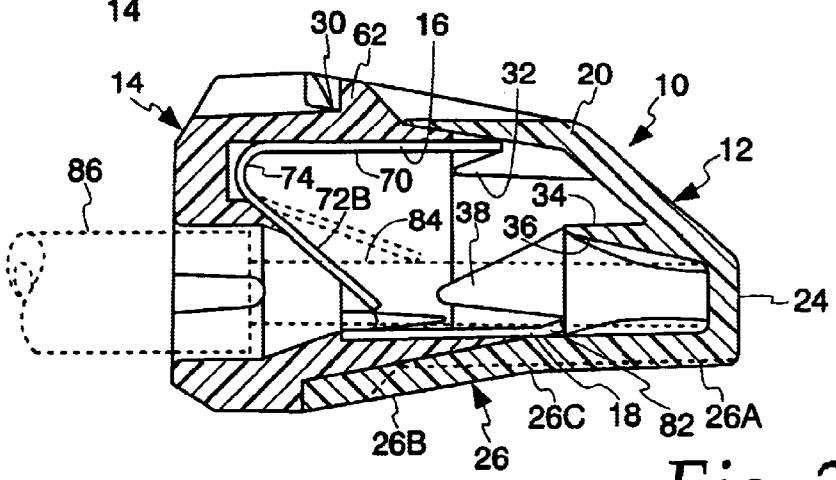
Fig. 2
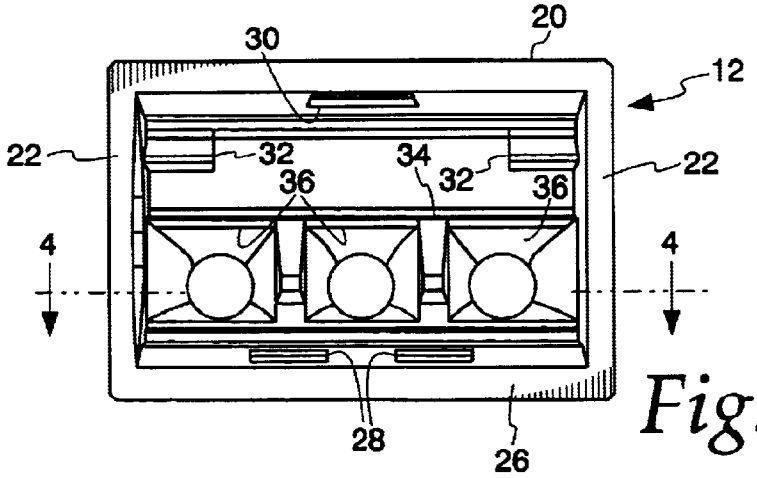
Fig. 3

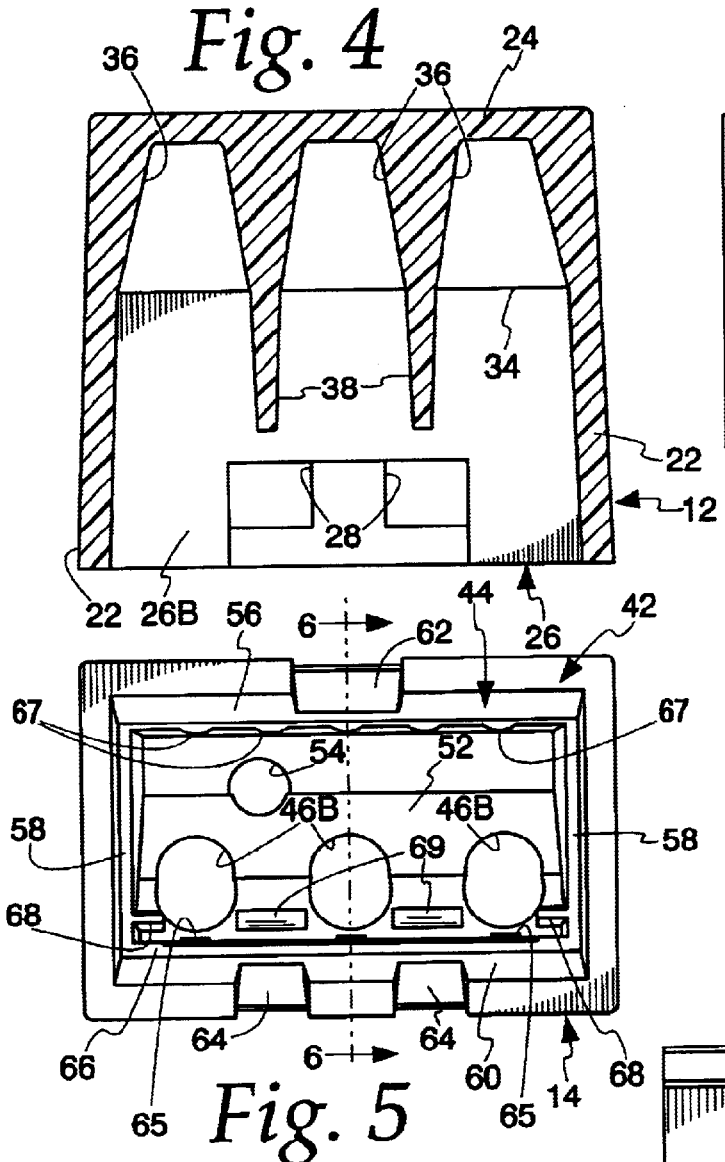
Fig. 4
Fig. 5
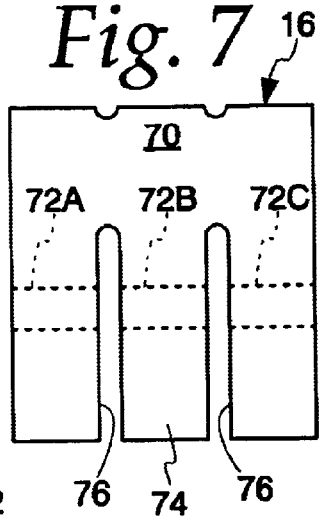
Fig. 7
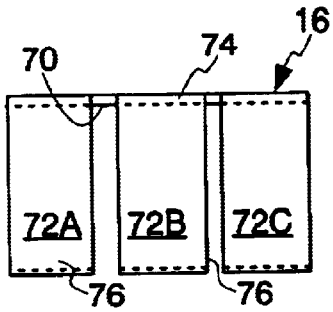
Fig. 8
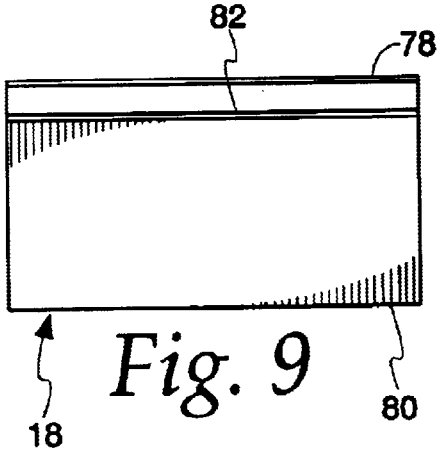
Fig. 9
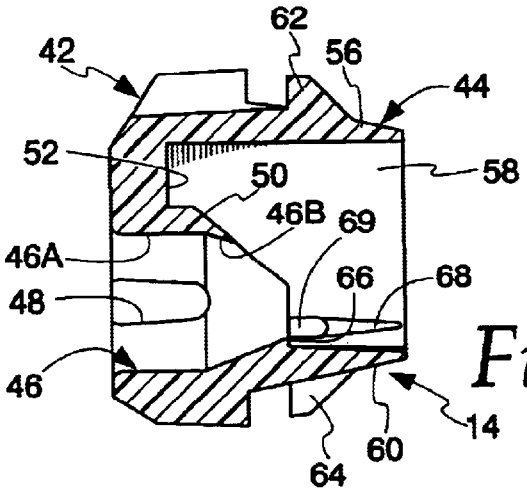
Fig. 6

PUSH-IN WIRE CONNECTOR

BACKGROUND OF THE INVENTION

This invention relates to push-in electrical connectors of the type wherein the stripped ends of electrical wires are pushed into the connector for the purpose of making electrical and mechanical connection between the wires.

Prior art push-in wire connectors include a housing with a one-piece conductive clip disposed in the housing. The housing insulates the electrical connection made by the clip between the wires. The clip also provides a force against the conductors to retain them in the housing and sustain an electrical connection between the wires. In this way, the conductive clips in prior art wire connectors must provide the dual functions of mechanically retaining the wires within the housing and forming an electrically conductive path between two or more wires.

In order to adequately provide both these functions, prior art conductive clips teach a construction having a first, flat base portion, a second upright portion which has openings positioned adjacent the openings in the housing, and a third spring portion which folds back onto the first portion to define a cantilevered spring. The electrical conductors extend through the openings in the second portion when the electrical conductors are inserted into the housing. Once the electrical conductors extend through the openings, they are positioned between the base and spring portions so as to provide a clamping force to the electrical conductors and retain the conductors within the push-in wire connector. U.S. Pat. No. 4,824,395 shows an example of this construction.

The one-piece construction of prior art conductive clips requires that they be made of materials which provide elasticity and conductivity. Some prior art conductive clips are made of bi-metal constructions with a layer of copper alloy next to a layer of steel. Other prior art conductive clips are made of copper alloys, phosphor bronze or spring temper brass to provide the springlike and conductive characteristics. However, stainless steel could not be used in prior art wire connectors because it does not provide adequate electrical conductivity between the electrical conductors. Thus, it was assumed that stainless steel and other materials with poor conductive properties were undesirable materials from which to make the spring clip because the spring clip had to provide good electrical conductivity.

Other prior art push-in connectors have a spring that is separate from a conductive plate. While this alleviates the materials problem noted above, the prior art constructions of which the present inventor is aware require that the spring and conductive plate be combined, connected or otherwise attached to one another in a sub-assembly outside of the connector housing prior to placement of the sub-assembly in the housing. This complicates the machinery needed to manufacture the connector, leading to higher costs.

The present invention overcomes these aspects of the prior art by providing a pressure spring which can be easily manufactured and that is not required to provide electrical conductivity between the electrical connectors which are placed within the housing. Neither does the spring have to be pre-assembled with any other components prior to final assembly of the connector.

SUMMARY OF THE INVENTION

The present invention relates to push-in electrical connectors having a housing including a case and a cap which together define an enclosure. A plurality of front ports are formed in the cap to provide access to the enclosure. Each port receives an end of an electrical conductor such as an electrical wire which has been stripped of its insulation. A rear block in the case defines a plurality of tapered receptacles each one of which is located spaced from and aligned with one of the entry ports. The receptacles receive and retain the free end of a conductor inserted into the connector.

Fixed within the housing and between the ports and receptacles are a pressure spring clip and a busbar. The pressure spring has a base plate from which extend a plurality of legs, one for each port and receptacle pair. The legs flexibly urge the electrical conductors inserted into the connector into electrical engagement with the busbar. The pressure spring's base plate and the busbar are each supported partially by the case and partially by the cap. The busbar has an angled rear edge that assures two points of contact between the busbar and the conductors inserted in the connector.

The present invention provides a connector construction which is simple to make and assemble and cheaper to manufacture. The connector does not depend upon the pressure spring to provide an electrical path between the conductors. Neither is the pressure spring called upon to align the conductors as that task is accomplished by the aligned pairs of ports and receptacles. Instead, all the pressure spring has to do is bias the conductors into engagement with the electrically conductive busbar. In this way, the material of the pressure spring is not limited to an electrically conductive metal but rather can be made of any material which provides sufficient biasing force to the conductors so as to maintain an electrical connection with the busbar. Further, the pressure spring and busbar need not be connected to one another, nor are they in engagement with one another. This reduces the cost of the connector and reduces the steps required to manufacture the connector.

BRIEF DESCRIPTION OF THE DRAWINGS

FIG. 1 is an exploded perspective view of the connector of the present invention.

FIG. 2 is a vertical section along a longitudinal plane of the connector.

FIG. 3 is an front end elevation view of the case showing the interior construction of the case.

FIG. 4 is a section taken along line 4—4 of FIG. 3.

FIG. 5 is an end elevation view of the cap, looking at the inside or interior of the cap.

FIG. 6 is a section taken along line 6—6 of FIG. 5.

FIG. 7 is a top plan view of the pressure spring.

FIG. 8 is a front elevation view of the pressure spring, looking at the vertex.

FIG. 9 is a top plan view of the busbar.

DETAILED DESCRIPTION OF THE INVENTION

FIG. 1 illustrates the components of the electrical connector 10 of the present invention. These include a case 12, a cap 14, a pressure spring 16, and a busbar 18. The case 12 and cap 14 fit together to form a housing having a hollow enclosure in which the spring 16 and busbar 18 are mounted. The housing is made from an insulative material, such as thermoplastic, but is not limited thereto. The housing can be made of nylon, polypropylene, polycarbonate or any suitable thermoplastic material. While it is preferred that the housing is molded from clear polycarbonate and the insert is molded from nylon, other combinations are also possible. Details of the individual components will now be described.

As seen in FIGS. 1–4, the case 12 is a generally five-sided compartment having a top wall 20, two side walls 22, a rear wall 24 and a bottom wall 26. It will be noted that the bottom wall has a main portion 26A and an angled portion 26B. The main portion 26A extends forwardly from the rear wall 24 to a step 26C (FIG. 2) where it joins the angled portion 26B. The angled portion 26B has a pair of lower retention slots or openings 28 formed therein. There is a similar upper slot 30 in the top wall 20. At the upper rear corners where the top wall 20, side walls 22 and rear wall 24 converge there are a pair of projections 32. These are for locating the pressure spring 16, as will be described below. A rear block 34 extends across the bottom wall main portion 26A from side wall to side wall and adjoining the rear wall. Three ports or receptacles 36 are formed in the rear block 34. Extensions 38 on the front of the block separate the receptacles. The receptacles 36 have square openings at the front, i.e., the left side as seen in FIG. 2. From the square openings the ports gradually taper back to cylindrical bottom or rear portions. The square openings substantially eliminate any front face on the rear block 34 that might otherwise cause pieces of stranded wire to get hung up prior to entry into the ports 36.

Turning now to the cap 14, it has a front block 42 and a telescoping portion 44 (FIG. 1) whose perimeter is smaller than the block 42. The perimeter of the block generally matches that of the case 12. Details of the front block 42 and telescoping portion 44 can be seen in FIGS. 5 and 6. Three entry ports or bores 46 extend through the block. Each port includes a cylindrical saddle portion 46A and a conical guide portion 46B. Cutouts 48 between the saddle portions simplify molding of the block 42. The interior of the block above the conical guide portions 46B defines an angled wall 50. Between the angled wall 50 and the top of the front block 42 is a recess 52. A test probe port 54 (FIG. 5) extends through the front block to provide access to the enclosure for a voltage tester probe. The rear edges of the block join the telescoping portion 44 of the cap. The telescoping portion includes top wall 56, side walls 58 and a bottom wall 60. The walls of the telescoping portion 44 are tapered so as to fit inside the open side of the case 12. An upper retention tab 62 is formed in the top wall 56. Two lower retention tabs 64 are formed in the bottom wall 60. The bottom wall also has a transverse ledge 66 and a three small ridges 65. A set of five rounded ridges 67 is formed on the underside of the top wall 56. The ridges 65 and 67 help align the pressure spring 16 and busbar 18. The ridges provide support to the spring and busbar as well as alignment that allows easier assembly of the case on the cap. A set of retainer lugs is included in the interior of the cap. Two side retainer lugs 68 are formed on the side walls 58 and the junction with the rear edge of the block 42. Two central retainer lugs 69 are formed on the rear edge of the block 42, between the bores 46.

FIGS. 7 and 8 illustrate the pressure spring 16. In this embodiment the spring has a generally V-shaped configuration including a base plate 70 and a plurality of legs 72A, 72B and 72C joined to the base plate 70 at a vertex 74. The legs 72A,B,C are separated by slots 76 which extend around the vertex and partially on to the base plate. The spring is preferably formed in a stamping die such that the free ends of the legs 72A,B,C have a burr edge that has a knifelike character. The knifelike edges will cut into an inserted conductor preventing easy removal of the conductors.

FIG. 9 illustrates the busbar 18. The busbar is a generally rectangular plate that has a rear edge 78 and a front edge 80. The rear edge 78 is angled upwardly slightly as seen as 82. This angled portion assures that there will be two points of contact with an inserted conductor. The busbar may be made of any conductive material such as, but not limited to, copper or a suitable copper alloy. Other variations in the constituent materials of the busbar are also possible, such as tin-plated copper. The busbar is designed to carry the current that the largest conductor is allowed to conduct by the U.S. National Electric Code.

Assembly of the connector components is as follows. The cap 14 is prepared by placing the pressure spring 16 and the busbar 18 into the cap. This may advantageously be done by turning the cap so the entry ports face down and the open side of the cap faces up. This arrangement allows the inserted spring and busbar to be retained primarily by gravity. The spring's vertex 74 is set in the recess 52 and the legs 72A,B,C lie against the angled wall 50 of the front block 42. Note also in FIG. 2 that the base plate 70 of the spring extends beyond the top wall 56 of the telescoping portion of the cap. The busbar 18 is inserted into the cap such that the front edge 80 of the busbar 18 abuts the transverse ledge 66 of the cap and is trapped by the retainer lugs 68 and 69. With the pressure spring 16 and busbar 18 in place in the cap, the case 12 is placed over the telescoping portion of the cap 14 until the front block 42 abuts the case. At that point the upper retention tab 62 will snap fit into the upper retention slot 30 while the lower retention tabs 64 will snap fit into the lower retention slots 28. The engagement of the tabs and slots prevents separation of the cap and case. With the two housing pieces assembled the free end of the spring base plate 70 will be captured by the projections 32 in the case. Similarly, the rear edge 78 of the busbar abuts the rear block 34 with the rear edge trapped underneath the extensions 38. As seen in FIG. 2, only a portion of the busbar adjacent the rear edge 78 rests on the bottom wall 26A of the case near the step 26C. Then the angled portion 26B drops away from the busbar, leaving a space where the bottom wall 60 of the cap's telescoping portion 44 fits in. Thus, the busbar is partially supported by the case 12 and partially by the cap 14.

The use of the connector is as follows. The connector 10 receives a plurality of electrical conductors, one of which is shown in phantom FIG. 2. The conductors are standard insulated electrical wires having a conductive core 84 surrounded by an insulation jacket 86. The stripped end of a wire is inserted into one of the entry ports 46 of the cap 14. As the wire core 84 moves into the enclosure, it is guided by the conical guide section 46B and contacts one of the legs of the pressure spring 16, for example leg 72B. This causes the leg to move in a counterclockwise direction, to the phantom position as seen in FIG. 2. The wire core is pressed by the leg 72B into contact with the busbar 18. The wire core continues into the case 12 and enters one of the receptacles 36. Thus, the core 84 is held at the front block 42 and the rear block 34. This reduces the tendency of the wire to cant or twist inside the housing. This in turn prevents the wire from moving out of alignment with the spring leg 72B. Note also that the angled portion of the busbar helps encourage contact between the conductor and the busbar. Additional wires are inserted in the same fashion. Electrical connection between the wires is established because the pressure spring 16 biases all the wires against the busbar 18 which provides the electrical path from one conductor to the next.

While the preferred form of the invention has been shown and described, it will be understood that there may be many modifications, substitutions and alterations thereto without departing from the scope of the claims. For example, while three wire ports have been shown for connecting three wires, a different number of ports could be provided to connect a different number of wires. Also, a different spring arrangement could be used to bias the conductors into contact with the busbar, e.g., individual cantilevered spring legs mounted in the housing.

What is claimed is:

1. A push-in connector for connecting electrical conductors, comprising:

a housing having a plurality of walls which define an enclosure and a plurality of receptacles, and the housing further having a plurality of entry ports formed in one of the walls, each entry port being aligned with and spaced from one receptacle, the entry ports providing access to the enclosure and each entry port defining an axis, the entry port axes being arranged in non-coaxial relation with one another, the receptacles receiving electrical conductors inserted through the entry ports;

a conductive busbar mounted to the housing in the enclosure between the entry ports and the receptacles; and a pressure spring directly mounted to the housing in the enclosure and engageable with electrical conductors inserted therein, the pressure spring being adapted to bias said electrical conductors into electrical engagement with the busbar;

wherein the pressure spring is spaced from the busbar such that no part of the pressure spring contacts the busbar.

2. The connector of claim 1 wherein the housing comprises a case and a cap attached to one another.

3. The connector of claim 1 wherein the busbar has an angled edge such that a conductor inserted into a receptacle will contact the busbar in at least two points.

4. The connector of claim 2 wherein the entry ports are formed in the cap and the receptacles are formed in the case.

5. The connector of claim 2 wherein the busbar has a rear edge supported in the case and a front edge supported in the cap.

6. The connector of claim 2 wherein the cap has a front block and a telescoping portion, the telescoping portion fitting inside the case.

7. The connector of claim 5 wherein the cap has a plurality of retainer lugs for locating the busbar.

8. The connector of claim 6 wherein the entry ports are formed in the front block and each entry port comprises a cylindrical saddle portion and a conical guide portion.

9. The connector of claim 6 wherein the front block defines a recess for receiving the pressure spring.

10. The connector of claim 6 wherein the front block defines an angled wall supporting the pressure spring prior to entry of said electrical conductors.

11. A push-in connector for connecting electrical conductors, comprising:

a housing having a plurality of walls which define an enclosure, and the housing further having a plurality of entry ports formed in one of the walls, the entry ports providing access to the enclosure and each entry port defining an axis, the entry port axes being arranged in non-coaxial relation with one another, the housing further including a plurality of receptacles therein, each one of the plurality of receptacles being aligned with one of the plurality of entry ports;

at least one projection formed on the housing and extending into the enclosure;

an electrically conductive busbar fixedly mounted in the housing; and a pressure spring directly mounted to the housing, the pressure spring including a base plate and a plurality of legs cantilevered from the base plate, the base plate engaging the projection to retain the base plate in a fixed position in the housing, the legs being normally positioned opposite the entry ports and spaced from the busbar and being flexibly movable such that the legs are deflected when electrical conductors are inserted into the housing, the pressure spring being engageable with inserted conductors to bias said electrical conductors into engagement with the busbar.

12. A push-in connector for connecting electrical conductors, comprising:

a housing having a plurality of walls which define an enclosure, and the housing further having a plurality of entry ports formed in one of the walls, the entry ports providing access to the enclosure and each entry port defining an axis, the entry port axes being arranged in non-coaxial relation with one another;

an electrically conductive busbar fixedly mounted in the housing;

a pressure spring having a base plate directly mounted to the housing and at least two flexible legs connected to the base plate and arranged opposite the entry ports prior to insertion of an electrical conductor such that when an electrical conductor is inserted into the housing through an entry port the legs engage the inserted conductor and bias it into engagement with the busbar, the pressure spring being spaced from the busbar such that no part of the pressure spring contacts the busbar.

13. A push-in connector for connecting electrical conductors, comprising:

a housing including a case and a cap which have a plurality of walls which cooperate to define an enclosure, the cap having a plurality of entry ports formed in one of the walls, the entry ports providing access to the enclosure, each entry port defining an axis, the entry port axes being arranged in non-coaxial relation with one another;

a conductive busbar having first and second edges, the first edge being supported in the case and the second edge being supported in the cap; and a pressure spring directly mounted to the housing in the enclosure and engageable with electrical conductors inserted therein, the pressure spring being adapted to bias said electrical conductors into electrical engagement with the busbar.

14. The connector of claim 13 wherein the pressure spring comprises a base plate, the base plate having first and second edges, the first edge being supported in the case and the second edge being supported in the cap.

15. The connector of claim 13 further comprising at least one retainer lug formed in the cap, the first edge of the busbar engaging the lug to retain the first edge in a fixed position in the housing.

16. The connector of claim 13 wherein the pressure spring has a base plate mounted in the housing and at least two flexible legs connected to the base plate and arranged opposite the entry ports prior to insertion of an electrical conductor such that when an electrical conductor is inserted into the housing through an entry port the legs engage the inserted conductor and bias it into engagement with the busbar, the pressure spring being spaced from the busbar such that no part of the pressure spring contacts the busbar.

17. The connector of claim 13 further comprising a plurality of retention tabs formed on one of the cap and case, a plurality of retention slots formed in the other of the cap and case, the retention tabs fitting in cooperative engagement in the retention slots to hold the cap and case together.

18. The connector of claim 14 further comprising a plurality of receptacles formed in the case, each one of the receptacles being aligned with one of the plurality of entry ports, and at least a portion of the pressure spring and the busbar being mounted intermediate the receptacles and the entry ports.

19. The connector of claim 14 further comprising at least one projection formed in the case, the first edge of the base plate engaging the projection to retain the first edge in a fixed position in the housing.

20. The connector of claim 16 further comprising a plurality of receptacles formed in the case, each one of the receptacles being aligned with one of the plurality of entry ports, and at least a portion of the pressure spring and the busbar being mounted intermediate the receptacles and the entry ports.

* * * * *

UNITED STATES PATENT AND TRADEMARK OFFICE

CERTIFICATE OF CORRECTION

PATENT NO. : 6,746,286 B2
APPLICATION NO. : 10/091854
DATED : March 6, 2002
INVENTOR(S) : William E. Blaha It is certified that error appears in the above-identified patent and that said Letters Patent is hereby corrected as shown below:

Column 6, line 11, after "busbar;" insert the following paragraph:

"wherein the pressure spring is spaced from the busbar such that no part of the pressure spring contacts the busbar."

Column 6, line 48, after "busbar;" insert the following paragraph:

"wherein the pressure spring is spaced from the busbar such that no part of the pressure spring contacts the busbar."

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,746,286 B2
APPLICATION NO. : 10/091854
DATED : June 8, 2004
INVENTOR(S) : William E. Blaha It is certified that error appears in the above-identified patent and that said Letters Patent is hereby corrected as shown below:

Column 6, line 11, after "busbar;" insert the following paragraph:

"wherein the pressure spring is spaced from the busbar such that no part of the pressure spring contacts the busbar."

Column 6, line 48, after "busbar;" insert the following paragraph:

"wherein the pressure spring is spaced from the busbar such that no part of the pressure spring contacts the busbar."

This certificate supersedes Certificate of Correction issued August 22, 2006.

Signed and Sealed this

Tenth Day of October, 2006

JON W. DUDAS
*Director of the United States Patent and Trademark Office*